US007797761B2

(12) United States Patent
Epps

(10) Patent No.: US 7,797,761 B2
(45) Date of Patent: Sep. 21, 2010

(54) DISPOSABLE AND SANITORY UPPER TORSO GARMENT FOR SHIELDING THE SKIN OF A PERSON FROM A BRASSIERE

(76) Inventor: Ronald E. Epps, 141-20 184th St., Springfield Gardens, NY (US) 11413

( * ) Notice: Subject to any disclaimer, the term of this patent is extended or adjusted under 35 U.S.C. 154(b) by 169 days.

(21) Appl. No.: 12/152,062

(22) Filed: May 12, 2008

(65) Prior Publication Data

US 2009/0276935 A1 Nov. 12, 2009

(51) Int. Cl.
*A41D 27/12* (2006.01)

(52) U.S. Cl. ..... 2/55; 2/54; 2/69

(58) Field of Classification Search ..... 2/69, 2/113–115, 105, 106, 46, 51, 54, 55
See application file for complete search history.

(56) References Cited

U.S. PATENT DOCUMENTS 1,227,428 A 5/1917 Greenberg
3,421,514 A * 1/1969 Friedlander ..... 450/30
4,866,790 A * 9/1989 Ross, Jr. ..... 2/84
4,982,450 A 1/1991 D'Huissier
5,042,089 A * 8/1991 Carmer ..... 2/55
5,120,264 A 6/1992 Van Engel
6,183,339 B1 * 2/2001 Thompson ..... 450/1
6,264,530 B1 7/2001 Cosentino
6,282,720 B1 9/2001 Mayer
6,336,839 B1 1/2002 Valli
6,591,425 B1 7/2003 Zellers
7,429,206 B2 * 9/2008 Perry ..... 450/86

* cited by examiner

*Primary Examiner*—Gloria Hale
(74) *Attorney, Agent, or Firm*—Richard L. Miller

(57) ABSTRACT

A method of shielding the skin, especially the armpits and the midriff, of a person from a brassiere when the person tries on the brassiere. The method includes the step of wearing, by the person, a disposable and sanitary upper garment that is made from a manufactured fiber in which the fiber forming substance is a long-chain synthetic polyamide in which less than 85% of the amide-linkages are attached directly (—CO—NH—) to two aliphatic groups.

1 Claim, 2 Drawing Sheets

Fig. 3
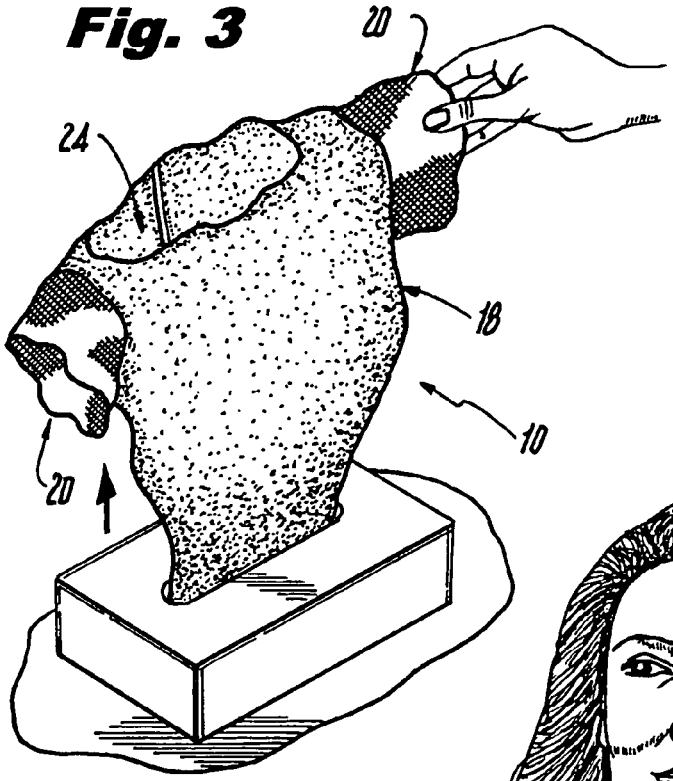
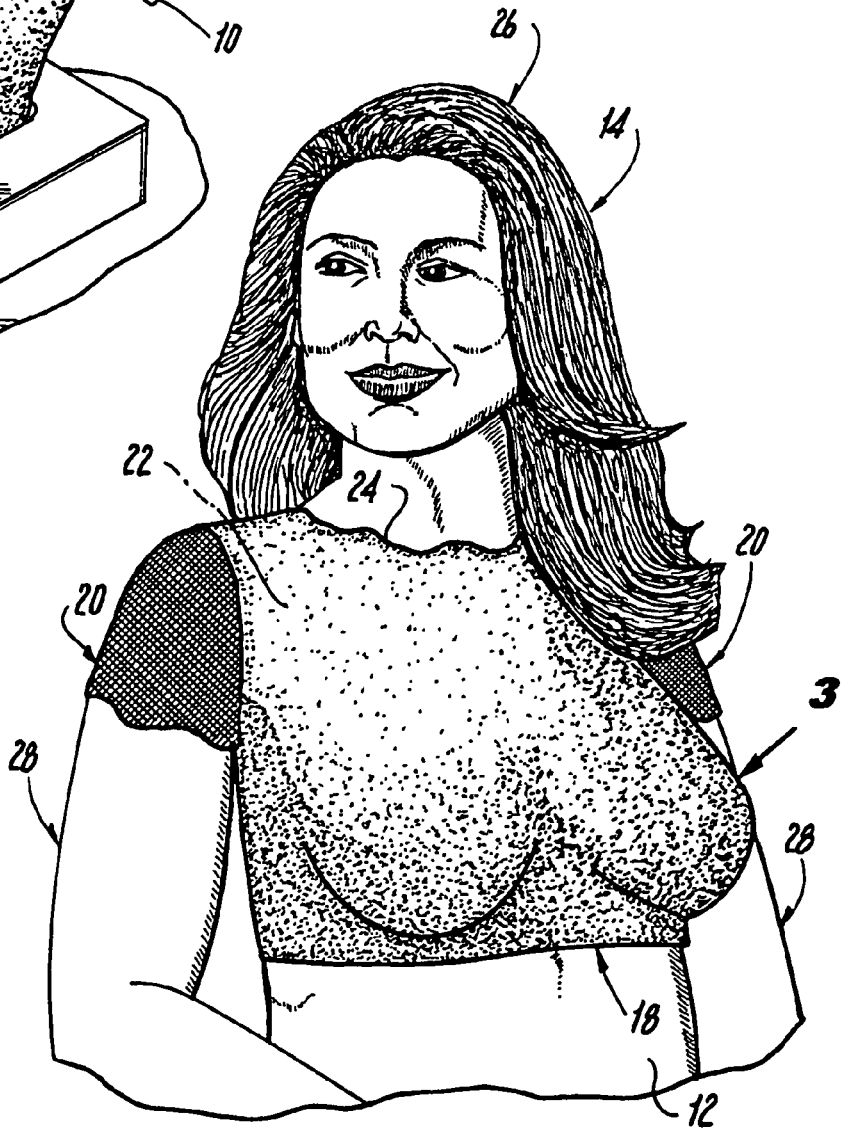
Fig. 2

DISPOSABLE AND SANITORY UPPER TORSO GARMENT FOR SHIELDING THE SKIN OF A PERSON FROM A BRASSIERE

1. BACKGROUND OF THE INVENTION

A. Field of the Invention

The embodiments of the present invention relate to an upper torso garment, and more particularly, the embodiments of the present invention relate to a disposable and sanitary upper torso garment for shielding the skin of a person from a brassiere when the person tries on the brassiere.

B. Description of the Prior Art

There are approximately 80% of women wearing an improper bra size through weight-loss and weight-gain, breast size fluctuates, and through pregnancy and young girls developing during puberty.

In department stores, women try bras on over T-shirts and other bras, and thus, do not get their correct bra sizes because of the increased bulk around their breasts from the T-shirts and the other bras. Women are still getting uncomfortable bras and incorrect sizes. Most boutiques and contour shops do not allow bras to be tried on. Measuring with a tape is not enough to get correct cup size.

Thus, there exists a need for a disposable and sanitary upper torso garment for shielding the skin of a person from a brassiere when the person tries on the brassiere.

Numerous innovations for upper-torso related devices have been provided in the prior art, which will be described below in chronological order to show advancement in the art, and which are incorporated herein by reference thereto. Even though these innovations may be suitable for the specific individual purposes to which they address, however, they differ from the present invention.

(1) U.S. Pat. No. 1,227,428 to Greenberg.

U.S. Pat. No. 1,227,428 issued to Greenberg on May 22, 1917 teaches a protective throw-away lining embodying normally exposed indicative apparatus for temporary attachment on the inside of a garment.

(2) U.S. Pat. No. 4,982,450 to D'Huissier.

U.S. Pat. No. 4,982,450 issued to D'Huissier on Jan. 8, 1991 in class 2 and subclass 402 teaches a protective device for temporary wear against the skin of a person trying on garments. The device includes a thin flexible sheet, and pressure-sensitive adhesive at opposite ends of the sheet to hold the sheet temporarily to the skin of a wearer. The sheet is a composite including an imperforate liquid impervious sheet of polyolefin about 3 to 15 mu in thickness and having bonded thereto on the same side as the adhesive, a hydrophilic web of fibers having a diameter of about 5 to 20 mu selected from the group including polypropylene and polyester. The web has a weight of about 10 to 30 g/msup 2.

(3) U.S. Pat. No. 5,120,264 to Van Engel.

U.S. Pat. No. 5,120,264 issued to Van Engel on Jun. 9, 1992 in class 450 and subclass 7 teaches a women's undergarment combining support for acting as a brassiere and underpants formed as a unitary garment made from nylon mesh fabric in one piece with a single flat seam at the back. A top band for breast support sized to fit around the upper torso of the female, with a lower triangular shaped portion that is wider in the front and has a thong-like shaped panty in the rear portion of the garment where it is unitarily formed. The undergarment has no visible seams, straps, hooks, or buttons, and is totally functional and unrestricting for the wearer.

(4) U.S. Pat. No. 6,264,530 to Cosentino.

U.S. Pat. No. 6,264,530 issued to Cosentino on Jul. 24, 2001 in class 450 and subclass 57 teaches a brassiere having a breast supporting portion with a moisture managing shield. The moisture managing shield faces towards the skin of a wearer and is attached to one side surface on the lower portion of the brassiere by a first adhesive layer. A depending lower portion of the shield is attached to the second or outside surface of the lower portion of the brassiere by a second adhesive layer by folding the shield along a lower edge. Each of the adhesive layers are initially covered by peel off strips until it is desired to expose their adhesive backings for mounting to the brassiere. Normally, the lower inside portion of the brassiere below the breast retaining cups is completely covered by the shield. The in-place shield may be removed from the brassiere by pulling on the shield allowing for its disposal and replacement by another shield when needed.

(5) U.S. Pat. No. 6,282,720 to Mayer.

U.S. Pat. No. 6,282,720 issued to Mayer on Sep. 4, 2001 in class 2 and subclass 113 teaches a shirt or upper cover including a torso enclosure and sleeves. The sleeves have short top lengths and long bottom lengths. The sleeve seams extend over the clavicle/acromin regions of the wearer of the shirt. Top regions of the torso enclosure and the tops of the sleeves follow the curvature of the shoulder substantially above the shoulder joints. The bottoms of the sleeves fold upwardly into the armpits of the wearer, providing perspiration absorbing cloth against skin regions of the torso and the arms.

(6) U.S. Pat. No. 6,336,839 to Valli.

U.S. Pat. No. 6,336,839 issued to Valli on Jan. 8, 2002 in class 450 and subclass 1 teaches a modular brassiere fitment apparatus provided for use in the determination of the brassiere size of a woman. The modular brassiere fitment apparatus has the same general appearance as an ordinary brassiere, except that it is based on a modular system. The first module includes a pair of breast cups, a connecting front panel, and two side panels. The second module includes a back panel. A third module may include a pair of shoulder straps. At least two first modules and at least two second modules make up a modular brassiere sizing kit where each of the first modules has a different size and each of the second modules has a different size, one from the other. When one of the first modules is assembled to one of the second modules from the modular brassiere sizing kit, the combination of the first and second modules constitutes a modular brassiere fitment apparatus. With the use of the modular brassiere sizing kit, the woman is able to mix and match different first modules and different second modules until she finds a combination that gives her a correct fit. Once the correct size of each of the first and second modules has been determined, the woman may easily purchase brassieres that will be comfortable and fit properly. When sizing, the first module will give a measurement of the woman's bust, while the second module will give a measurement of her midriff. On combining the two sizes, the woman then determines her brassiere size.

(7) U.S. Pat. No. 6,591,425 to Zellers.

U.S. Pat. No. 6,591,425 issued to Zellers on Jul. 15, 2003 in class 2 and subclass 54 teaches an underarm perspiration collecting shield that is part of the construction of an undergarment. The undergarment, designed primarily but not exclusively for men, includes a front and back torso section, sleeves covering the upper arms, and a neck opening for the head. The perspiration collecting shield is constructed of three layers. The layer closest to the wearer's underarm is constructed of material consistent with that used to make the undergarment. The middle layer is constructed of absorbent material capable of absorbing a minimum of 2 fluid oz of perspiration before becoming saturated. The middle layer is permanently bonded to a third layer of pliable waterproof material to prevent moisture from leaking through to the wearer's clothing. These three layers, as one item, are sewn into the underarm area of the garment, extending into the front and torso sections.

It is apparent that numerous innovations for upper-torso related devices have been provided in the prior art that are adapted to be used. Furthermore, even though these innovations may be suitable for the specific individual purposes to which they address, however, they would not be suitable for the purposes of the embodiments of the present invention as heretofore described.

2. SUMMARY OF THE INVENTION

Thus, an object of the embodiments of the present invention is to provide a disposable and sanitary upper torso garment for shielding the skin of a person from a brassiere when the person tries on the brassiere, which avoids the disadvantages of the prior art.

Briefly stated, another object of the embodiments of the present invention is to provide a method of shielding the skin, especially the armpits and the midriff, of a person from a brassiere when the person tries on the brassiere. The method includes the step of wearing, by the person, a disposable and sanitary upper garment, which includes an upper torso enclosure and a pair of short sleeves. The upper torso garment covers the upper torso of the person and has a neck opening to allow passage of the head of the person therethrough. The pair of short sleeves extend from the upper torso garment and allow passage of the arms of the person therethrough. The disposable and sanitary upper torso garment is made from a manufactured fiber in which the fiber forming substance is a long-chain synthetic polyamide in which less than 85% of the amide-linkages are attached directly (—CO—NH—) to two aliphatic groups, so as to allow the disposable and sanitary upper torso garment to conform to the contour of the upper torso of the person without changing the contour of the upper torso of the person to thereby allow proper fit of the brassiere.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows:

FIG. 2 is a diagrammatic perspective view of the disposable and sanitary upper torso garment of the embodiments of the present invention shielding the skin of a person;

FIG. 3 is a diagrammatic perspective view of the disposable and sanitary upper torso garment of the embodiments of the present invention identified by ARROW 3 in FIG. 2 being removed from a sanitary package;

4. LIST OF REFERENCE NUMERALS UTILIZED IN THE DRAWING

Figure 1:
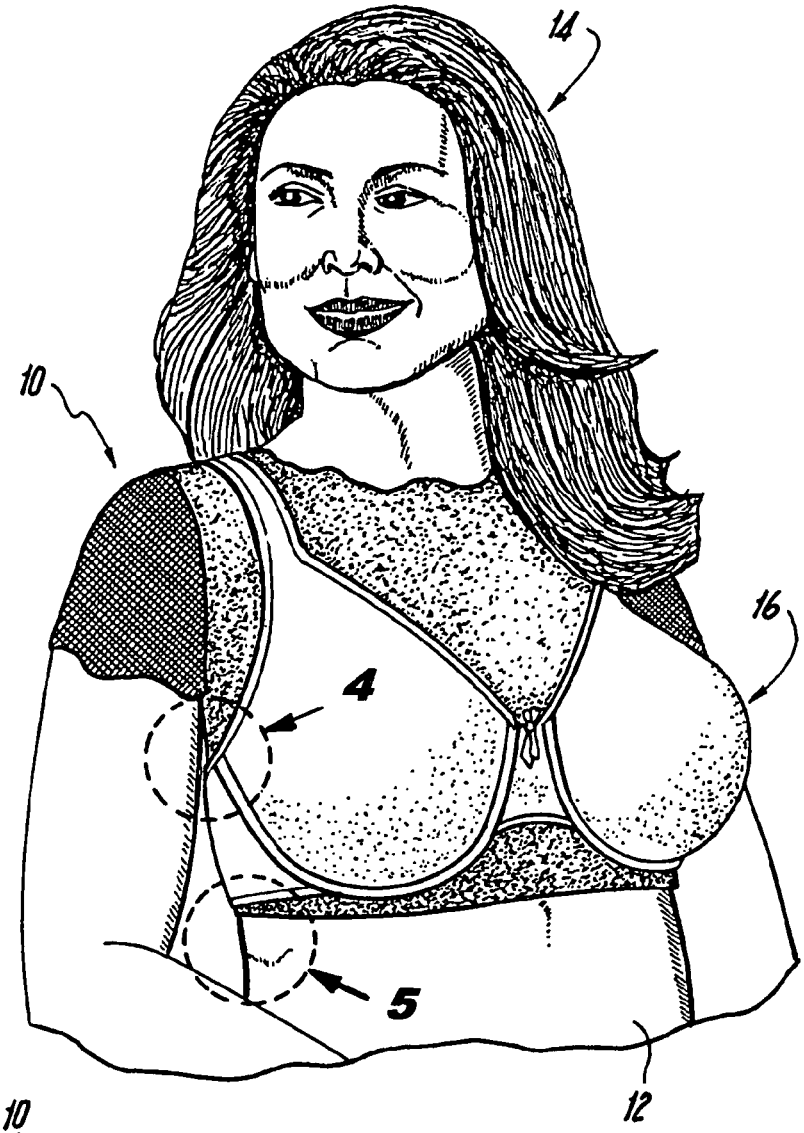
FIG. 1 is a diagrammatic perspective view of the disposable and sanitary upper torso garment of the embodiments of the present invention shielding the skin of a person from a brassiere when the person tries on the brassiere.

A. General.

10 disposable and sanitary upper torso garment of embodiments of present invention for shielding skin 12 of person 14 from brassiere 16 when person 14 tries on brassiere 16

12 skin of person 14

14 person

16 brassieres

B. Configuration of Disposable and Sanitary Upper Torso Garment 10.

18 upper torso enclosure for covering upper torso 22 of person 14

20 pair of short sleeves for passage of arms 28 of person 14 therethrough

22 upper torso of person 14

24 neck opening in upper torso enclosure 18 for passage of head 26 of person 14 therethrough

26 head of person 14

28 arms of person 14

30 armpits of person 14

32 midriff of person 14

5. DETAILED DESCRIPTION OF THE PREFERRED EMBODIMENTS

A. General.

Referring now to the figures, in which like numerals indicate like parts, and particularly to FIGS. 1 and 2, which are, respectively, a diagrammatic perspective view of the disposable and sanitary upper torso garment of the embodiments of the present invention shielding the skin of a person from a brassiere when the person tries on the brassiere, and a diagrammatic perspective view of the disposable and sanitary upper torso garment of the embodiments of the present invention shielding the skin of a person, the disposable and sanitary upper torso garment of the embodiments of the present invention is shown generally at 10 for shielding the skin 12 of a person 14 from a brassiere 16 when the person 14 tries on the brassiere 16.

B. The Configuration of the Disposable and Sanitary Upper Torso Garment 10.

The configuration of the disposable and sanitary upper torso garment 10 can best be seen in FIGS. 2 and 3, which, which are, respectively, a diagrammatic perspective view of the disposable and sanitary upper torso garment of the embodiments of the present invention shielding the skin of a person, and a diagrammatic perspective view of the disposable and sanitary upper torso garment of the embodiments of the present invention identified by ARROW 3 in FIG. 2 being removed from a sanitary package, and as such, will be discussed with reference thereto.

The disposable and sanitary upper torso garment 10 comprises an upper torso enclosure 18 and a pair of short sleeves 20. The upper torso garment 18 is for covering the upper torso 22 of the person 14, and has a neck opening 24 for passage of the head 26 of the person 14 therethrough. The pair of short sleeves 20 extend from the upper torso garment 18, and are for passage of the arms 28 of the person 14 therethrough.

Figure 4:
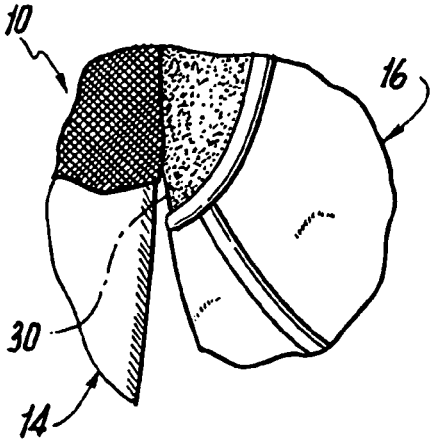
FIG. 4 is an enlarged diagrammatic perspective view of the area generally enclosed by the dotted curve identified by ARROW 4 in FIG. 1.

As shown in FIG. 4, which is an enlarged diagrammatic perspective view of the area generally enclosed by the dotted curve identified by ARROW 4 in FIG. 1, the disposable and sanitary upper torso garment 10 shields the armpits 30 of the person 14 from the brassiere 16 when the person 14 tries on the brassiere 16.

Figure 5:
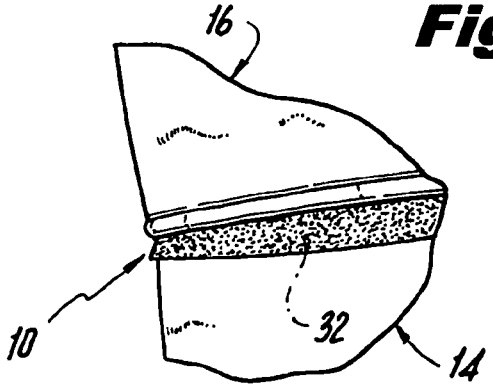
FIG. 5 is an enlarged diagrammatic perspective view of the area generally enclosed by the dotted curve identified by ARROW 5 in FIG. 1.

As shown in FIG. 5, which is an enlarged diagrammatic perspective view of the area generally enclosed by the dotted curve identified by ARROW 5 in FIG. 1, the disposable and sanitary upper torso garment 10 shields the midriff 32 of the person 14 from the brassiere 16 when the person 14 tries on the brassiere 16.

The disposable and sanitary upper torso garment 10 is made from a manufactured fiber in which the fiber forming substance is a long-chain synthetic polyamide in which less than 85% of the amide-linkages are attached directly (—CO—NH—) to two aliphatic groups, so as to allow the disposable and sanitary upper torso garment 10 to conform to the contour of the upper torso 22 of the person 14 without changing the contour of the upper torso 22 of the person 14 to thereby allow proper fit of the brassiere 16.

C. The Conclusions.

It will be understood that each of the elements described above or two or more together may also find a useful application in other types of constructions differing from the types described above.

While the embodiments of the present invention have been illustrated and described as embodied in a disposable and sanitary upper torso garment for shielding the skin of a person from a brassiere when the person tries on the brassiere, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A method of shielding the skin, especially the armpits and the midriff, of a wearer from a brassiere when the wearer tries on the brassiere, comprising the steps of:

a) providing a disposable and sanitary upper garment that comprises:

i) an upper torso enclosure; and ii a pair of short sleeves;

wherein the upper torso enclosure is for covering the upper torso of the wearer;

wherein upper torso enclosure has a neck opening;

wherein said neck opening in the upper torso enclosure is for passage of the head of the wearer therethrough;

wherein said pair of short sleeves extend from the upper torso enclosure;

wherein said pair of short sleeves are for passage of the arms of the wearer therethrough; and wherein the disposable and sanitary upper torso garment is made from a manufactured fiber in which the fiber forming substance is a long-chain synthetic polyamide in which less than 85% of the amide-linkages are attached directly (—CO—NH—) to two aliphatic groups, so as to allow the disposable and sanitary upper torso garment to conform to the contour of the upper torso of the wearer without changing the contour of the upper torso of the wearer to thereby allow for proper fit of the brassiere;

b) placing the upper torso garmnent onto the person; and c) trying on the brassiere over the upper torso garment.

* * * * *